US009862019B2

(12) United States Patent
Andrew

(10) Patent No.: US 9,862,019 B2
(45) Date of Patent: Jan. 9, 2018

(54) FASTENER INSTALLATION TOOL

(71) Applicant: INFASTECH INTELLECTUAL PROPERTIES PTE LTD, Singapore (SG)

(72) Inventor: Simon Andrew, Abbotts Langley (GB)

(73) Assignee: Infastech Intellectual Properties PTE. LTD., Singapore (SG)

( * ) Notice: Subject to any disclaimer, the term of this patent is extended or adjusted under 35 U.S.C. 154(b) by 0 days.

(21) Appl. No.: 14/390,302

(22) PCT Filed: Dec. 24, 2012

(86) PCT No.: PCT/GB2012/053269
§ 371 (c)(1),
(2) Date: Oct. 2, 2014

(87) PCT Pub. No.: WO2013/150256
PCT Pub. Date: Oct. 10, 2013

(65) Prior Publication Data

US 2015/0052719 A1 Feb. 26, 2015

(30) Foreign Application Priority Data

Apr. 3, 2012 (GB) ..... 1205978.8

(51) Int. Cl.

| | |
|---|---|
| ***B21J 15/02*** | (2006.01) |
| ***B21J 15/04*** | (2006.01) |
| ***B21J 15/10*** | (2006.01) |
| ***B21J 15/22*** | (2006.01) |

(52) U.S. Cl.
CPC ..... *B21J 15/022* (2013.01); *B21J 15/043* (2013.01); *B21J 15/105* (2013.01); *B21J 15/22* (2013.01); *Y10T 29/5377* (2015.01)

(58) Field of Classification Search
CPC ..... B21J 15/022; B21J 15/22; B21J 15/043; B21J 15/105; B21J 15/326; B21J 15/28; B21J 15/18
See application file for complete search history.

(56) References Cited

U.S. PATENT DOCUMENTS

| | | | | | |
|---|---|---|---|---|---|
| 2,526,956 | A * | 10/1950 | Kugler | B21J 15/105 | 30/228 |
| 3,039,270 | A * | 6/1962 | Simmons | B21J 15/022 | 227/10 |
| 3,254,522 | A * | 6/1966 | Elliott | B21J 15/105 | 227/130 |
| 4,192,389 | A | 3/1980 | Raman | | |
| 4,515,005 | A * | 5/1985 | Klein | B21J 15/105 | 29/243.525 |

(Continued)

*Primary Examiner* — Monica Carter
*Assistant Examiner* — Seahee Yoon
(74) *Attorney, Agent, or Firm* — Vorys, Sater, Seymour and Pease LLP; Rex W. Miller, II

(57) ABSTRACT

A pneumatically powered fastener installation tool (2) comprising floating pull (24) and return (26) pistons which are free to move axially within the main channel (22), thereby providing compliance when transmitting pressure from a double-acting pneumatic piston (16) and intensifier rod (18) to a head piston (6) thereby to install a fastener such as a lockbolt and preventing the generation of a vacuum condition on oil loss during the pull stroke of the tool.

8 Claims, 26 Drawing Sheets

(56) References Cited

U.S. PATENT DOCUMENTS

| | | | | | |
|---|---|---|---|---|---|
| 4,580,435 | A * | 4/1986 | Port | B21J 15/022 | 29/243.525 |
| 4,597,263 | A * | 7/1986 | Corbett | B21J 15/022 | 29/243.525 |
| 4,770,023 | A * | 9/1988 | Schwab | B21J 15/105 | 29/243.523 |
| 5,485,727 | A * | 1/1996 | Godfrey | B21J 15/105 | 29/243.523 |
| 5,742,989 | A * | 4/1998 | Subotsch | B21J 15/105 | 29/243.523 |
| 6,532,635 | B1 * | 3/2003 | Gregory | B21J 15/105 | 29/243.523 |

* cited by examiner

FASTENER INSTALLATION TOOL

CROSS REFERENCE TO RELATED APPLICATIONS

The application is a national phase filing of International Application No. PCT/GB2012/053269, filed on Dec. 24, 2012, which claims priority to Great Britain Application No. 1205978.8, filed on Apr. 3, 2012, each of which is incorporated herein by reference.

BACKGROUND AND SUMMARY

This invention relates to a pneumatically powered installation tool for installing fasteners such as lockbolts, i.e. fasteners comprising a groove stem including a breaker groove, and a collar.

Known tools for installing lockbolt fasteners install the lockbolt into a workpiece by swaging the collar onto the grooved stem. On depression of the tool trigger, a pull stroke is initiated, whereby compressed air is fed to one side of a double-acting pneumatic piston, thereby causing movement of the piston and of an intensifier rod which is coupled to the piston. The movement of the piston and rod causes movement of a head piston, which in turn causes actuation of the jaws within the tool head. The tool applies a pulling force to the stem of a fastener via the jaws, thereby causing a collar to be swaged onto the stem. The pulling force is applied until the stem is caused to break at the breaker groove. The tool applies a 'push-off' force via reversed movement of the head piston, to eject the collar from the tool head.

After the trigger is released, a return stroke is initiated whereby the head piston and the pneumatic piston return to their original positions.

In currently known lockbolt installation tools, two hydraulic lines are provided to the head to produce the double-acting piston motion which is required to install the lockbolt. These hydraulic lines are usually provided by the double-acting pneumatic piston which actuates the intensifier rod which acts in both directions of movement.

However, in prior art tools in which the two hydraulic lines are of fixed volumes, any oil loss in the pull side causes a loss of stroke and a vacuum condition during the return stroke, causing aeration of the oil and reduced tool performance. Any oil loss in the return side prevents the head piston from fully returning, which in turn results in reduced engagement of the tool jaws on the lockbolt stem, thereby increasing the chance of failure of the tool nose equipment or the lockbolt.

To counter the above effect, an oil reservoir and a pressure relief valve is normally used to provide a secondary circuit, providing additional hydraulic volume. Oil from the reservoir is drawn in when there is an imbalance in the oil volumes, and when the head returns to its end stop, any excess volume is pushed through the pressure relief valve.

The provision of the oil reservoir and pressure relief valve increases tool complexity, bulk, and cost. Furthermore, if the pressure relief output valve is connected to the pull side, and there is an obstruction preventing the head from fully returning, excess oil is discharged into the pull side. This results in the head piston starting the cycle partially back, thereby again reducing engagement of the tool jaws with the grooved stem of the lockbolt, and increasing the chance of failure of the tool nose equipment or the lockbolt.

An aim of the current invention is to provide a lockbolt installation tool which does not suffer from a gradual loss of stroke, which ensures full engagement of the tool jaws with the grooved lockbolt stem and thereby prevents potential failure of the tool nose equipment or the lockbolt.

Accordingly the present invention comprises a pneumatically powered fastener installation tool comprising a head section, a handle section, and pneumatic installation means comprising a pneumatic piston coupled to an intensifier rod, wherein the intensifier rod extends into a main channel within the handle section of the tool, and wherein a pull piston and a return piston are provided within the main channel, and wherein the pull piston and the return piston are free to move within the main channel in a direction axially with respect to the main channel and wherein in use, the tool conducts a cycle comprising a pull stroke and a return stroke thereby to install a fastener.

The present invention uses floating pistons to provide compliance when transmitting pressure from the double acting pneumatic piston to the head piston. In the volume between the floating pistons, air is provided via a vent to atmosphere. The floating pistons are free to take whatever position dependent upon the hydraulic displacement. Any oil loss on the pull stroke will not cause a vacuum condition in the oil volumes within the tool.

A first embodiment of the present invention includes a secondary oil circuit, comprising a positively pressured oil reservoir connected via a check valve and a pressure relief valve (in parallel) to the return side of the main channel.

In a second embodiment aspect of the present invention, a secondary reservoir is not provided. Instead, an integrated reservoir is provided by an excess of oil in the return volume itself. Therefore, there is a lost pneumatic piston stroke in a normal cycle. However, if oil is lost from the return side, extra pneumatic piston stroke is available. As oil is lost, the hydraulic pull and return pistons move apart from each other within the main channel.

Preferably a seal is provided, which is fitted to the pneumatic piston, and acts to seal the air inlet/exhaust on the pull side when the pneumatic piston is at the end of the return stroke.

Preferably a small diameter aperture through the pneumatic piston is also provided. The aperture acts as an air bleed across the piston, i.e. between the pull and return sides of the pneumatic piston, thereby equalising the pressures on either side when the tool is at rest. As there is a larger area on the return side of the pneumatic piston, pressure is always maintained on the seal to ensure sealing. However, the pressure on the return side of the head piston is greatly reduced.

The seal and the small diameter aperture act to reduce the hydraulic pressure which is held on the return side of the head piston during tool inactivity.

Because the reservoir in the second embodiment is integrated, the component count of the tool is reduced, and tool complexity, bulk and cost are reduced.

BRIEF DESCRIPTION OF THE DRAWINGS

Embodiments of the invention will now be described by way of example only and with reference to the figures in which.

DETAILED DESCRIPTION OF THE DRAWINGS

Figure 14:
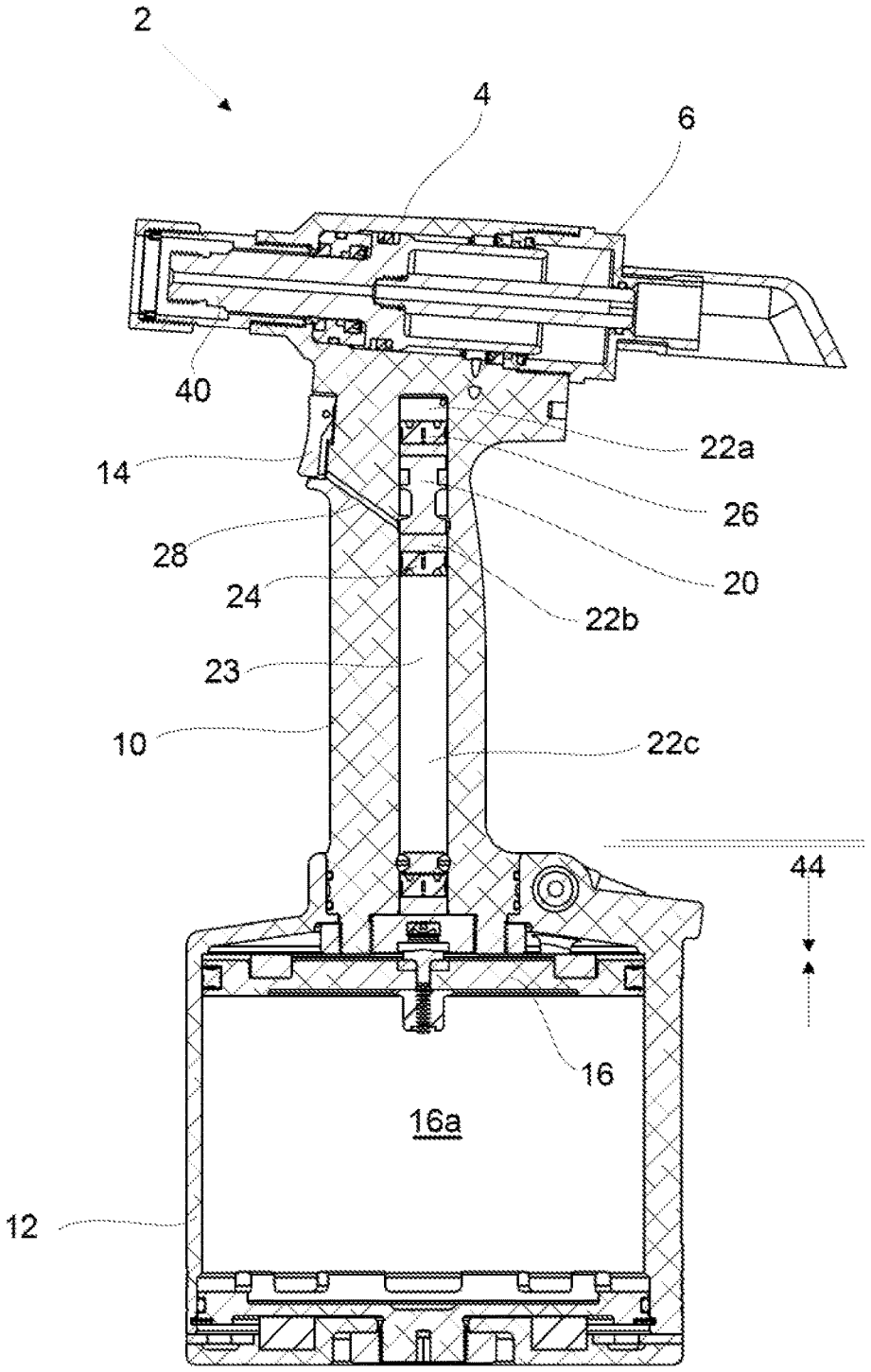
FIG. 14 is a cross-sectional view of the second embodiment of the tool along the lines B-B of FIG. 9 when the tool is in a rest position.
Figure 15:
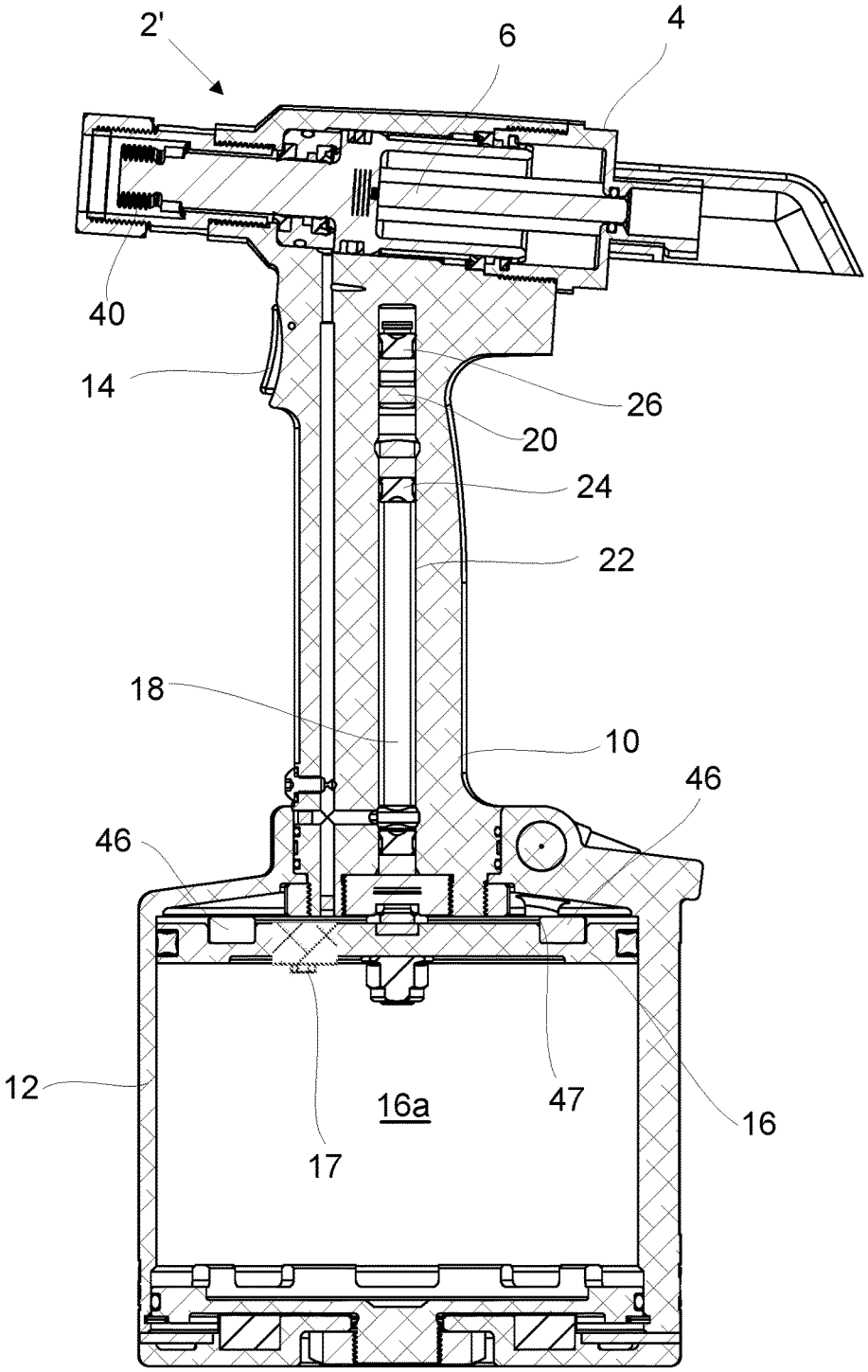
FIG. 15 is a cross-sectional view of the second embodiment of the tool along the lines C-C of FIG. 9 when the tool is in a rest position.
Figure 18:
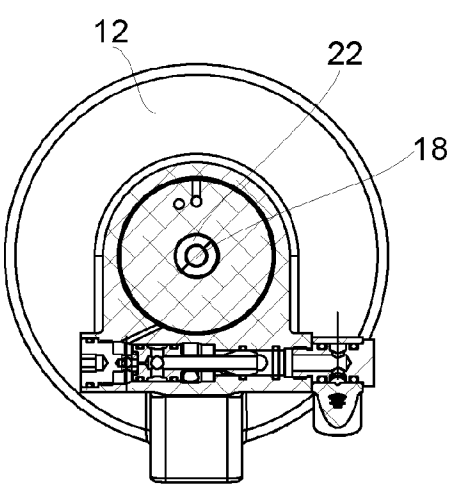
FIG. 18 is a cross-sectional view of the second embodiment of the tool along the lines F-F of FIG. 8 when the tool is at the end of the pull stroke.
Figure 17:
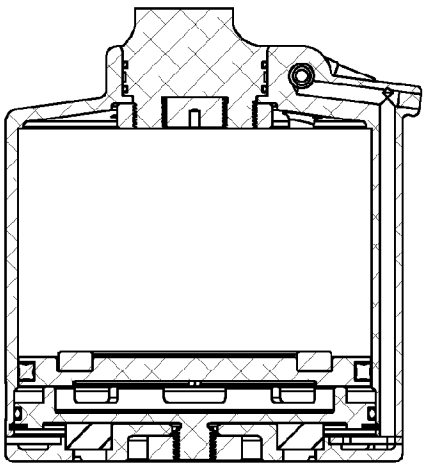
FIG. 17 is a cross-sectional view of the second embodiment of the tool along the lines E-E of FIG. 8 when the tool is at the end of the pull stroke.
Figure 16:
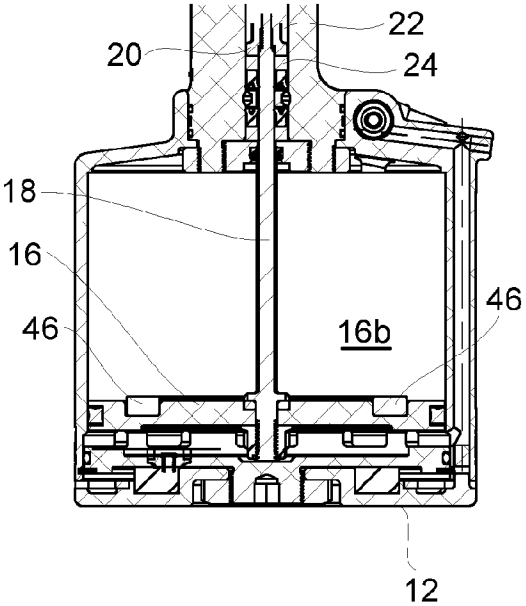
FIG. 16 is a cross-sectional view of the second embodiment of the tool along the lines D-D of FIG. 8 when the tool is at the end of the pull stroke.
Figure 19:
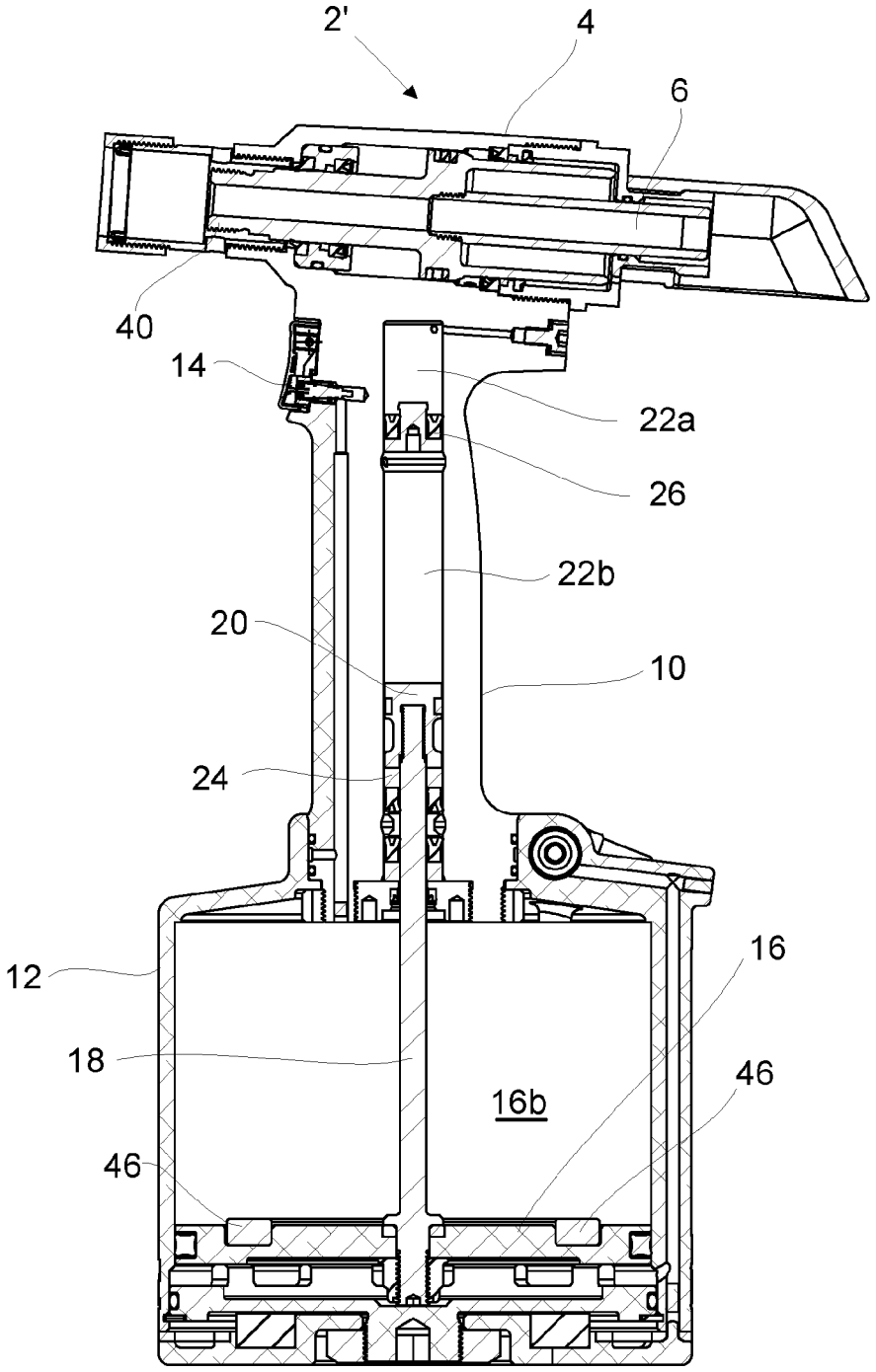
FIG. 19 is a cross-sectional view of the second embodiment of the tool along the lines A-A of FIG. 9 when the tool is at the end of the pull stroke.
Figure 20:
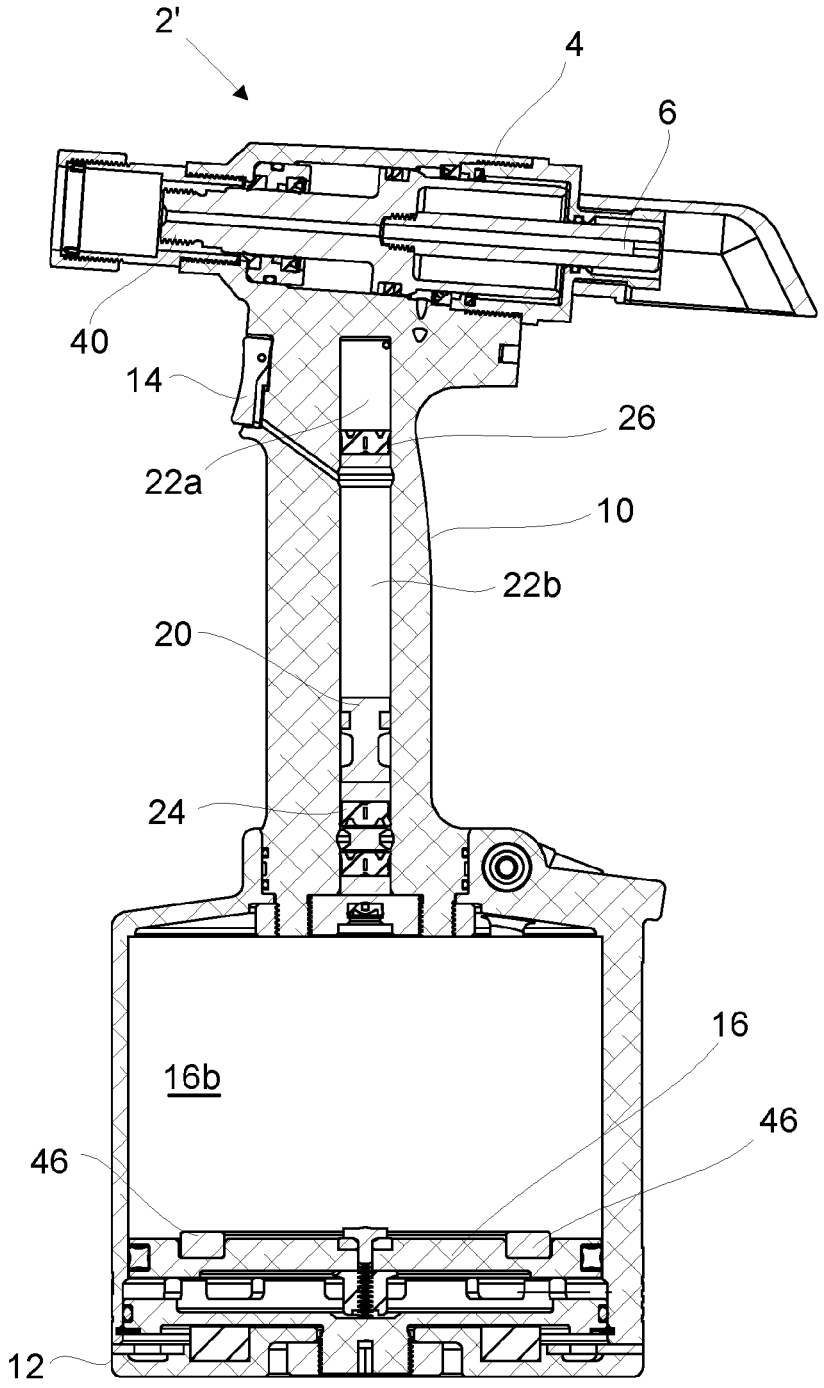
FIG. 20 is a cross-sectional view of the second embodiment of the tool along the lines B-B of FIG. 9 when the tool is at the end of the pull stroke.
Figure 21:
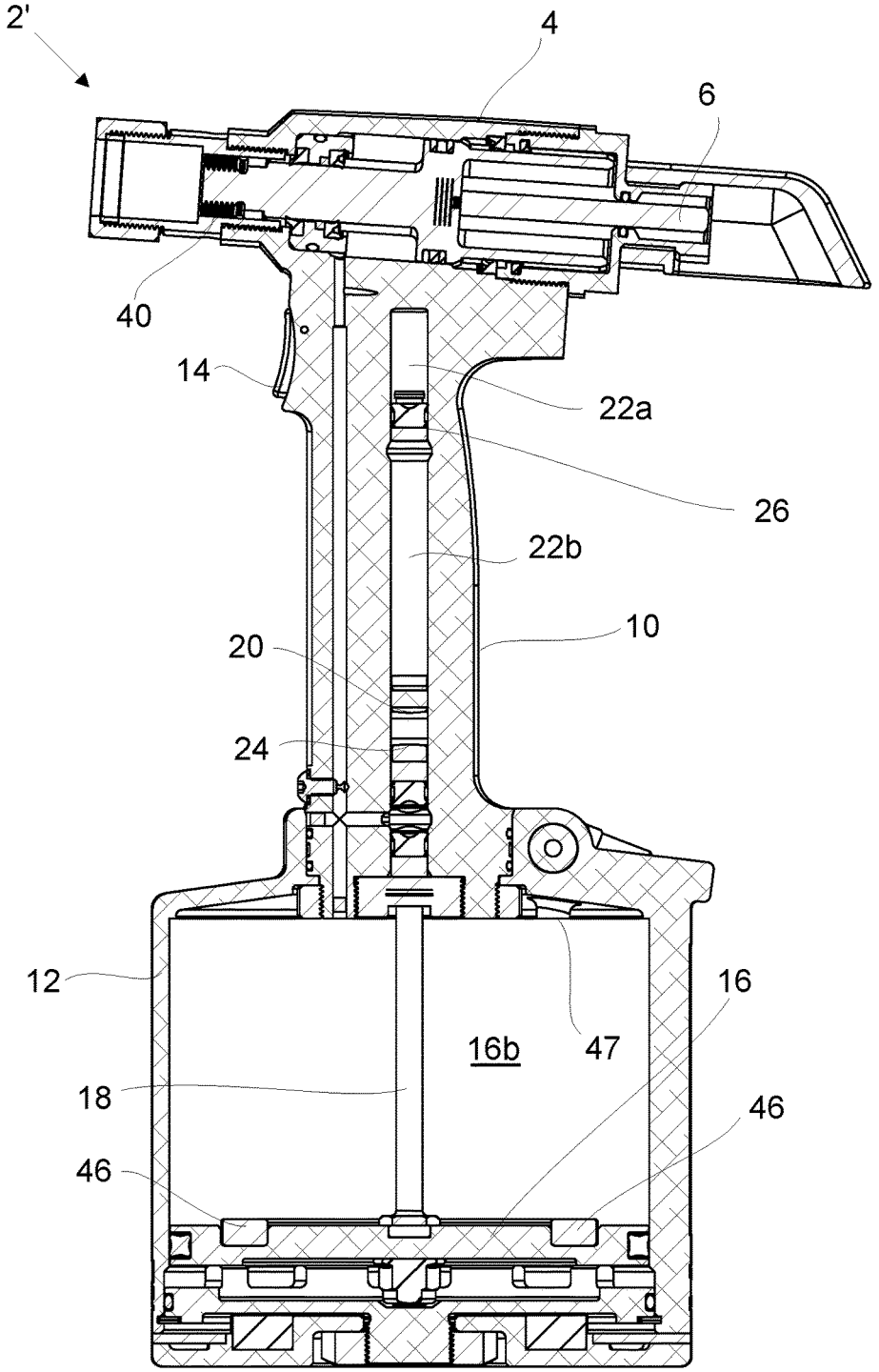
FIG. 21 is a cross-sectional view of the second embodiment of the tool along the lines C-C of FIG. 9 when the tool is at the end of the pull stroke.
Figure 24:
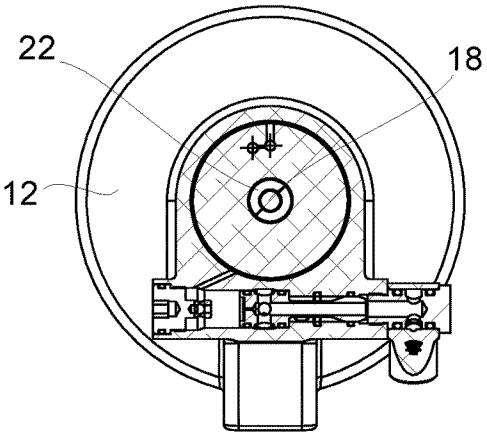
FIG. 24 is a cross-sectional view of the second embodiment of the tool along the lines F-F of FIG. 8 when the tool is at the start of the return/push-off stroke.
Figure 23:
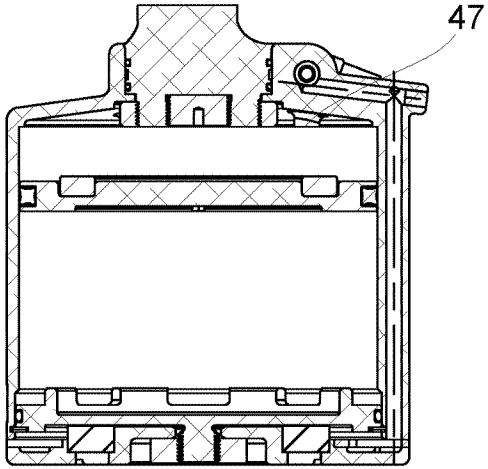
FIG. 23 is a cross-sectional view of the second embodiment of the tool along the lines E-E of FIG. 8 when the tool is at the start of the return/push-off stroke.
Figure 22:
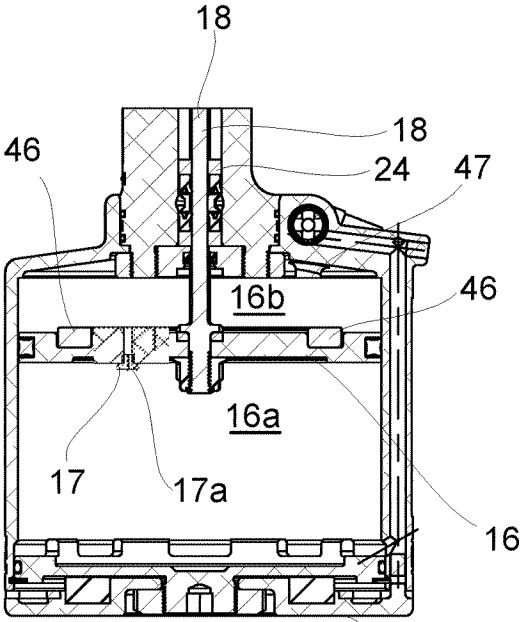
FIG. 22 is a cross-sectional view of the second embodiment of the tool along the lines D-D of FIG. 8 when the tool is at the start of the return/push-off stroke.
Figure 25:
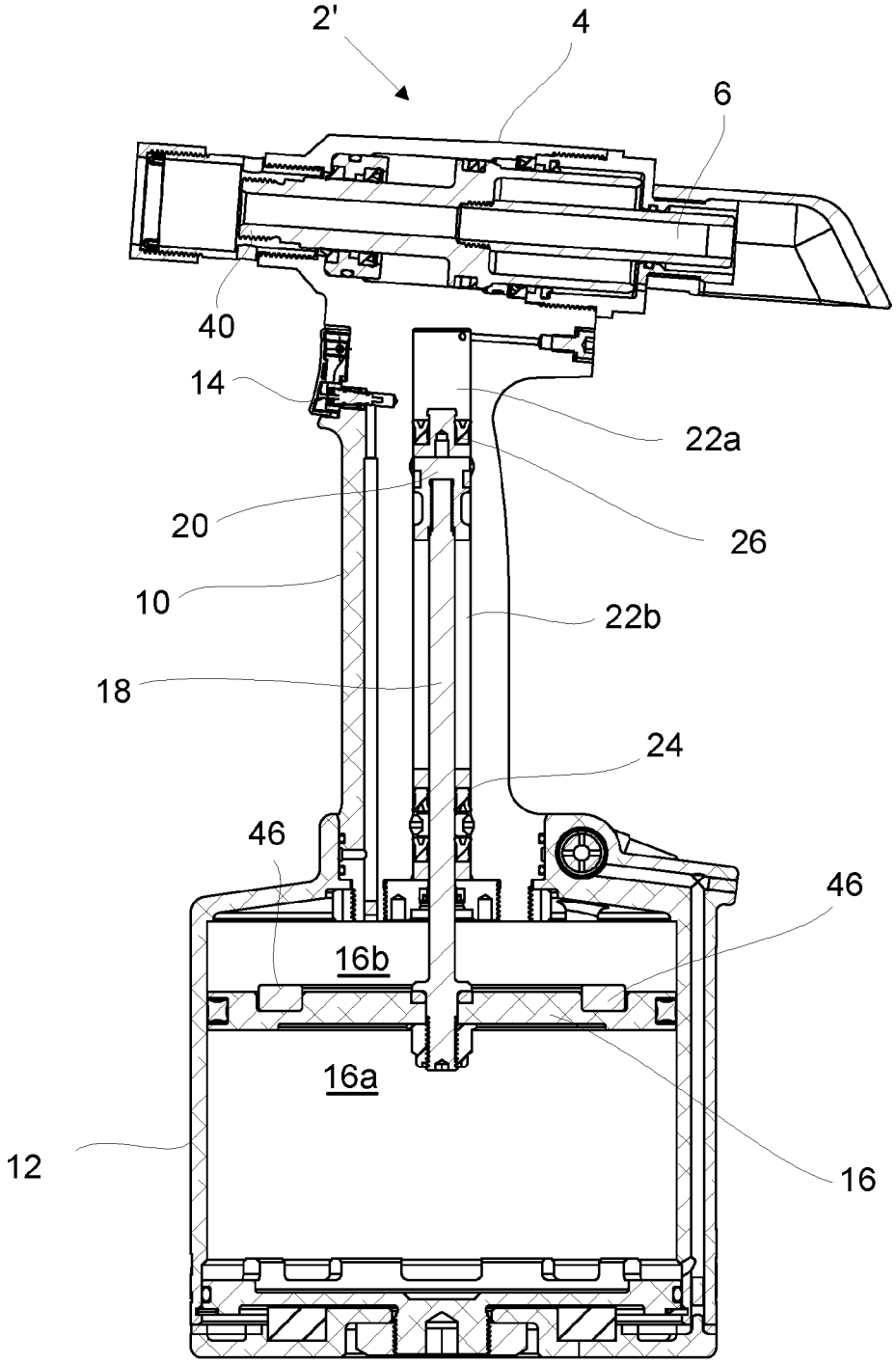
FIG. 25 is a cross-sectional view of the second embodiment of the tool along the lines A-A of FIG. 9 when the tool is at the start of the return/push-off stroke.
Figure 26:
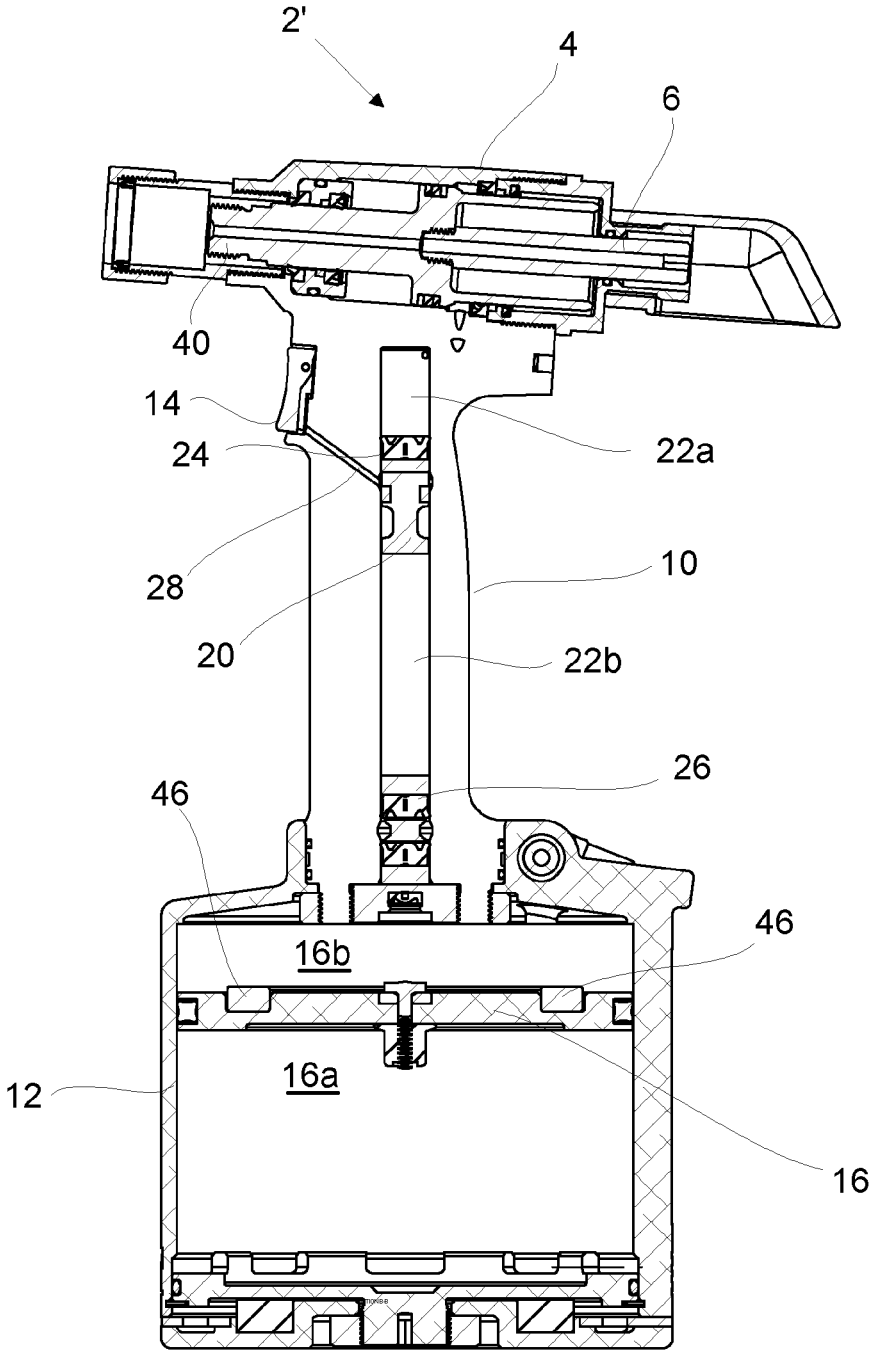
FIG. 26 is a cross-sectional view of the second embodiment of the tool along the lines B-B of FIG. 9 when the tool is at the start of the return/push-off stroke
Figure 27:
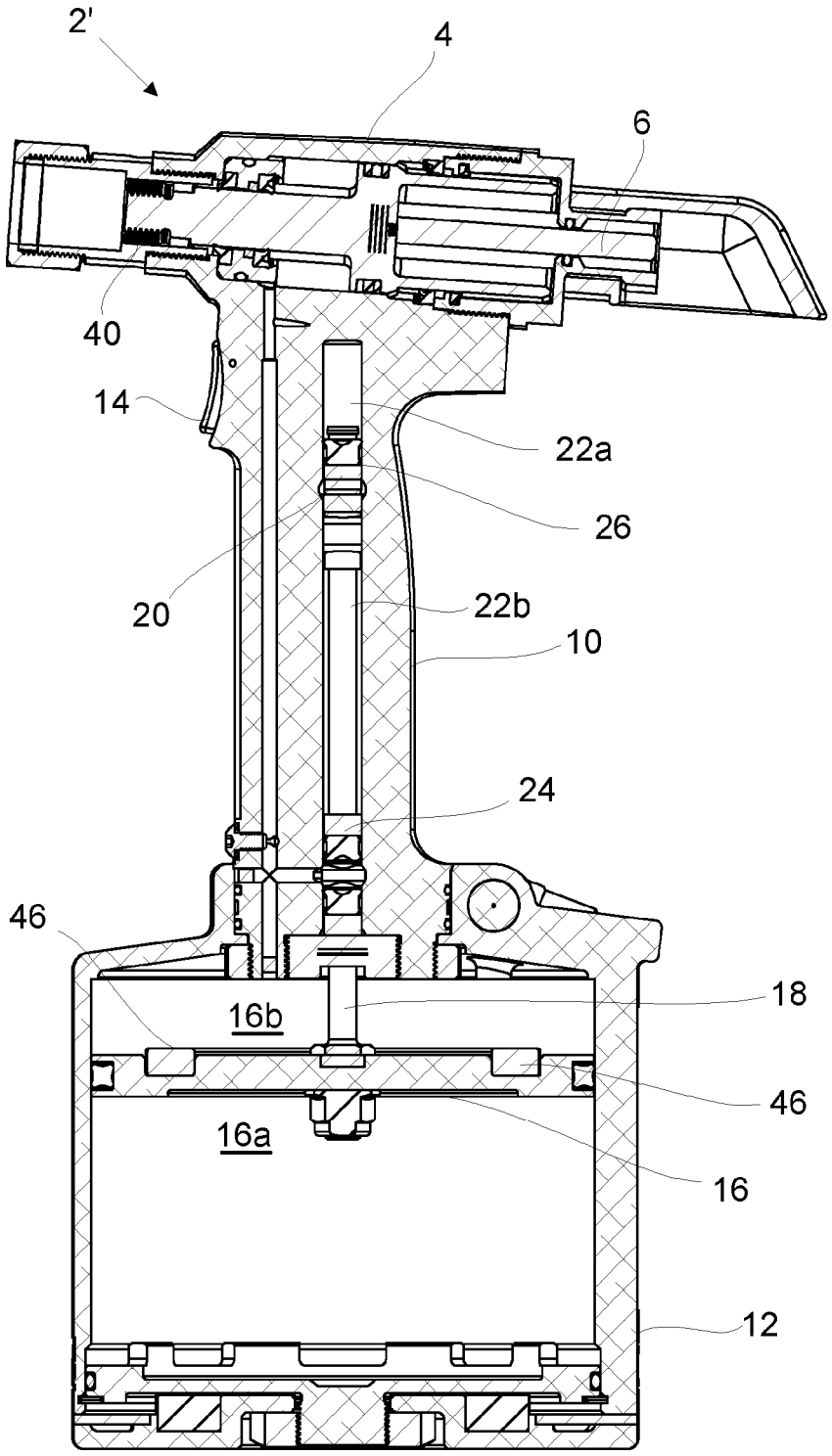
FIG. 27 is a cross-sectional view of the second embodiment of the tool along the lines C-C of FIG. 9 when the tool is at the start of the return/push-off stroke.
Figure 30:
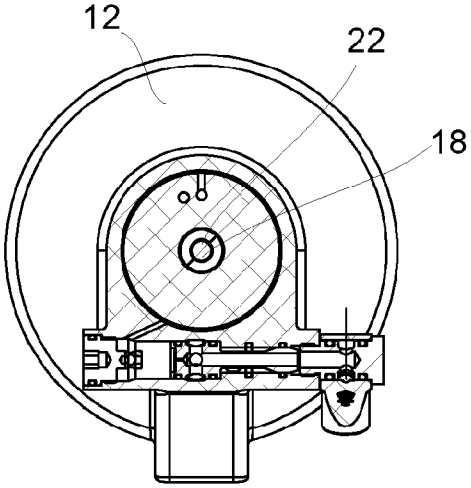
FIG. 30 is a cross-sectional view of the second embodiment of the tool along the lines F-F of FIG. 8 when the tool is at the end of the return/push-off stroke, with a full oil reservoir.
Figure 29:
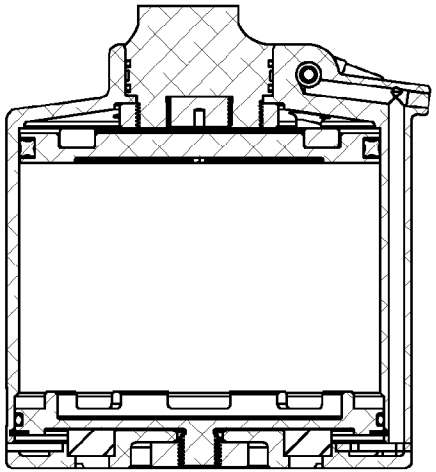
FIG. 29 is a cross-sectional view of the second embodiment of the tool along the lines E-E of FIG. 8 when the tool is at the end of the return/push-off stroke, with a full oil reservoir.

Referring to FIGS. 1 to 4, a tool 2 according to a first embodiment of the present invention comprises a head section 4 comprising a head piston 6, a handle section 10, a base section 12 and a trigger 14. The tool further comprises pneumatic installation means, comprising a pneumatic piston 16 within the base section 12 coupled to an intensifier rod 18 with a T-section 20 provided at the end of the rod 18 remote from the pneumatic piston 16. The rod 18 extends into a main channel 22 within the handle section 10 of the tool 2. A pull piston 24 and a return piston 26 are provided within the main channel 22 and seal against an inner bore 23 (FIG. 14) of the main channel 22. The pull piston 24 and the return piston 26 are not affixed to the rod 18 or the walls of the channel 22, and are therefore free to 'float' axially within the main channel 22, i.e. they are Free to move within the main channel 22 in an axial direction with respect to the main channel 22.

The main channel 22 is divided into three sections by the pull piston 24 and the return piston 26: a return side 22*a*, between the return piston 26 and the tool head section 4, a mid portion 22*b*, between the return piston 26 and the pull piston 24, and a pull side 22*c*, between the pull piston 24 and the base section 12 of the tool. The volume of each of the three sections is dependent upon the relative positions of the pull piston 24 and the return piston 26, and therefore varies throughout the tool cycle.

An air vent channel 28 is provided in the handle section 10 of the tool 2 leading into the main channel 22, thereby providing a vent to atmosphere from the main channel 22.

A secondary oil circuit 30 is provided within the handle section 10 of the tool 2. The secondary oil circuit 30 comprises a positively pressured oil reservoir 32 which is connected via a check valve 34 and pressure relief valve 36 in parallel to the check valve 34. The check valve 34 is checked in the direction from the return side 22*a* into the reservoir 32. A floating reservoir piston 40 is provided within the reservoir 32.

Figure 1:
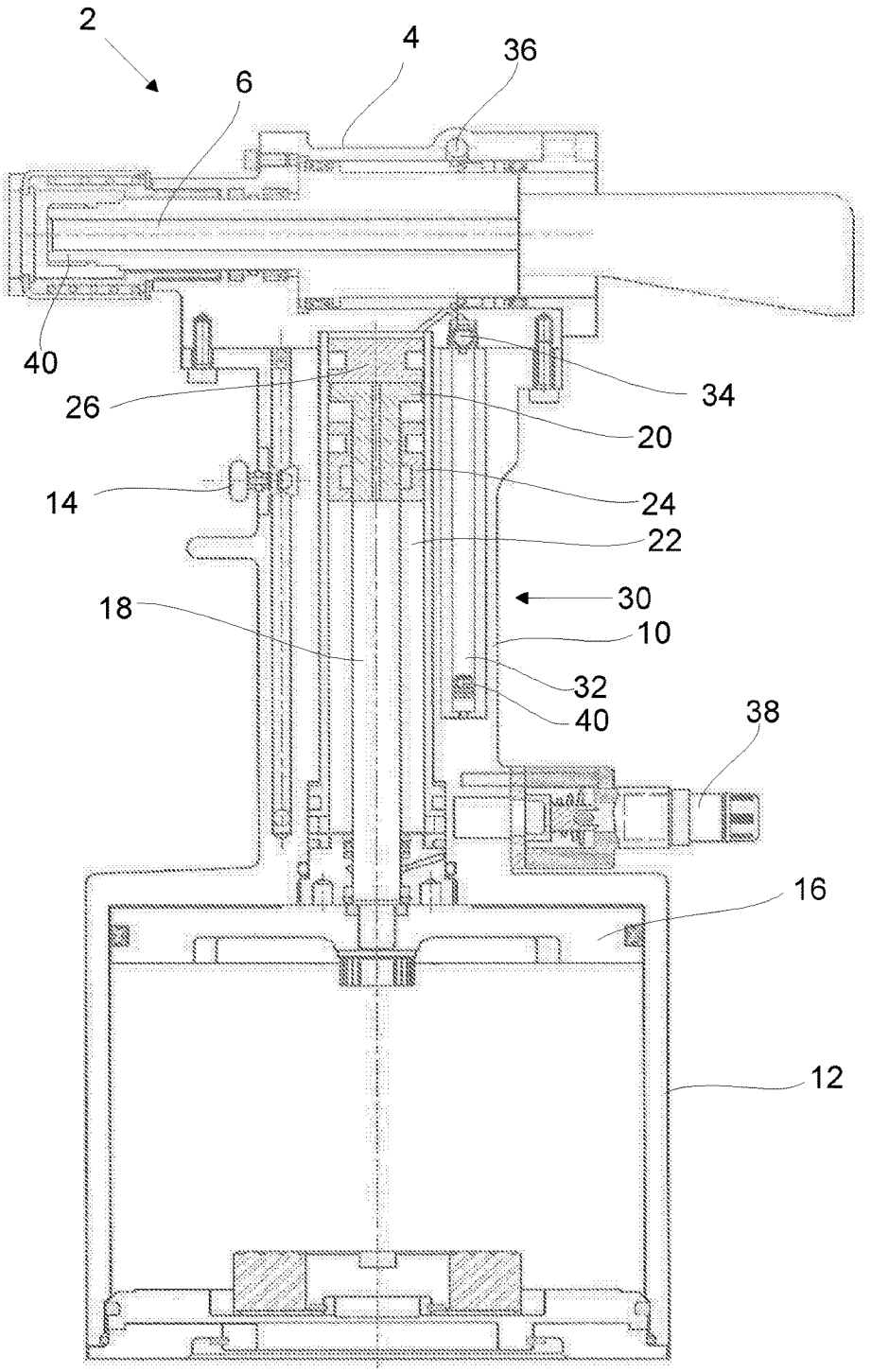
FIG. 1 is a cross-sectional view of tool in accordance with a first embodiment the present invention, wherein the tool is in an initial position.

In the initial position of the tool 2, as shown in FIG. 1, the pneumatic piston 16 is at the top (i.e. closest to the head section) of the base section 12 of the tool 2. Operation of the tool 2 is effected by depression of the tool trigger 14, thereby causing initiation of a pull stroke. During the pull stroke, compressed air is fed into the tool by a hose (not shown) via an air supply channel 38, and causes the pneumatic piston 16 and rod 18 to move away from the tool head section 4. The head piston 6 is therefore caused to retract, and the jaws (not shown) are thereby actuated to apply the necessary pulling force to the stem of a lockbolt (not shown) to swage the collar of the lockbolt onto the stem and subsequently to break the stem at a breaker groove, thereby installing the lockbolt.

During the pull stroke, as the rod 18 moves through the main channel 22 away from the tool head section 4, the T-section 20 contacts the pull piston 24 and causes the pull piston 24 also to move along the main channel 22 away from the tool head section 4. The return piston 26 is free to float within the main channel 22 between the T-section 20 and the tool head section 4. The air vent channel 28 allows the pressure on the return side 22*a* and in the mid portion 22*b* to be equalised.

Figure 2:
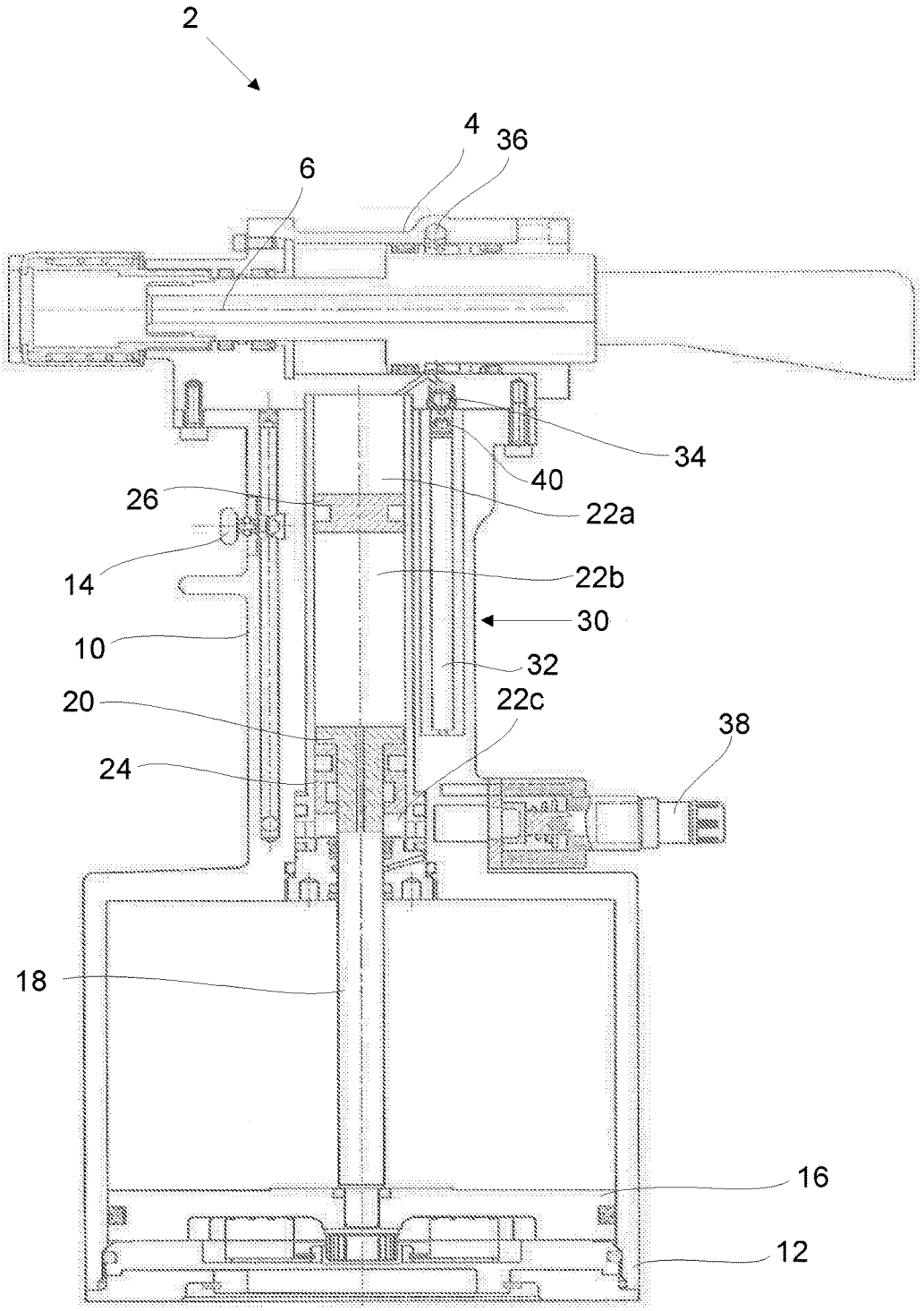
FIG. 2 is cross-sectional view of the tool of FIG. 2 wherein the tool is at the end of the pull stroke.

During the pull stroke of the tool, when there is minimal pressure in the return side 22*a* of the main channel 22, the positive pressure of the secondary oil circuit 30 causes oil to be pushed from the reservoir 32 into the return side 22*a* via the check valve 34 as shown in FIG. 2.

Figure 3:
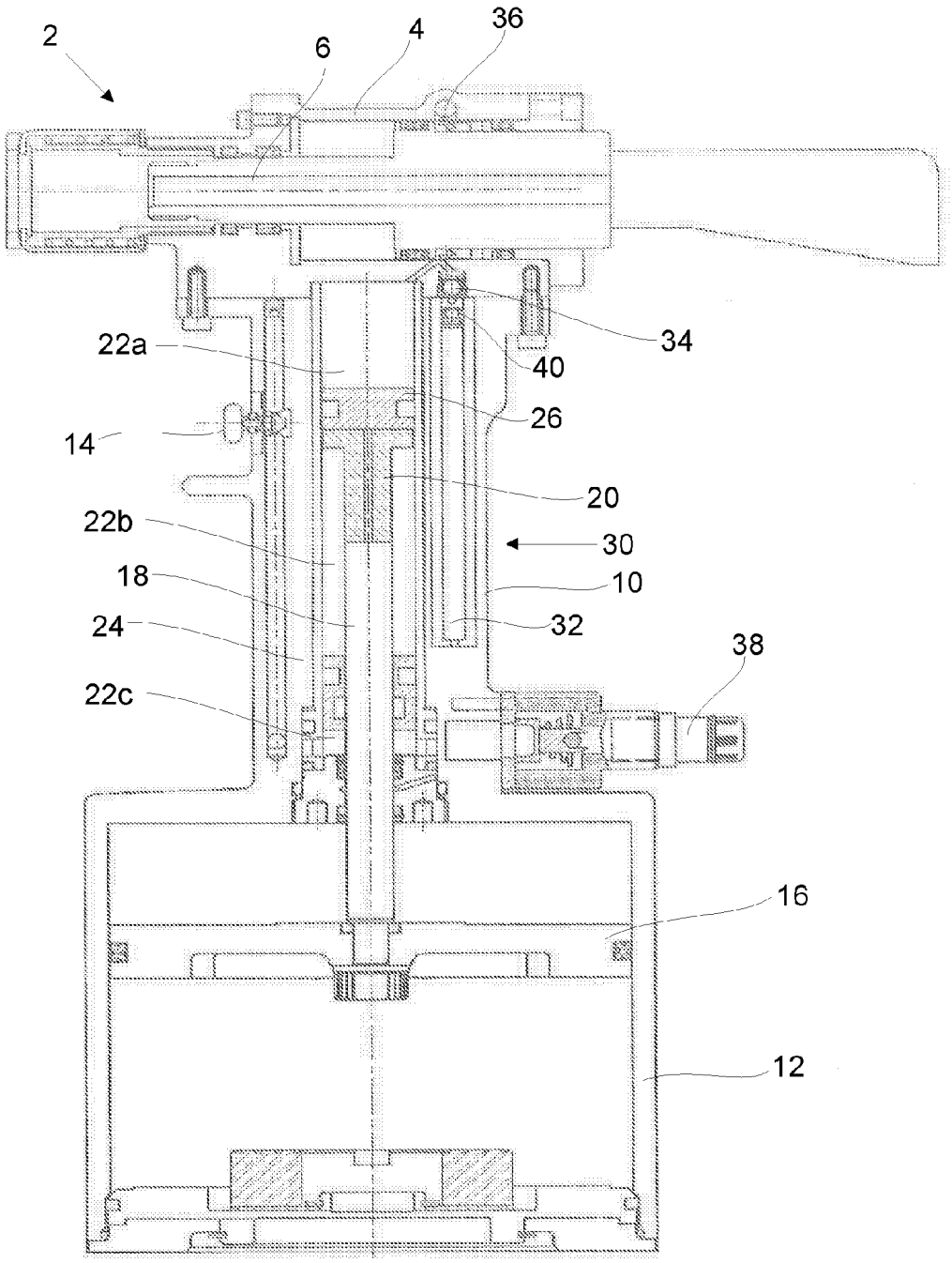
FIG. 3 is a cross-sectional view of the tool of FIG. 1 wherein the tool is at the start of the return/push-off stroke.

Release of the trigger 14 causes initiation of a return/push-off stroke, wherein the pneumatic piston 16 and rod 18 return to the initial position of FIG. 1. As the rod 18 moves along the main channel 22 towards the tool head section 4, the T-section 20 contacts the return piston 26 and pushes it towards the tool head section 4 as shown in FIG. 3. On the return stroke, the pull piston 24 is free to float within the main channel 22, thereby ensuring a vacuum condition does not occur on the pull side 22*c*. The air vent channel 28 allows the pressure on the pull side 22*c* and in the mid portion 22*b* to be equalised.

Figure 4:
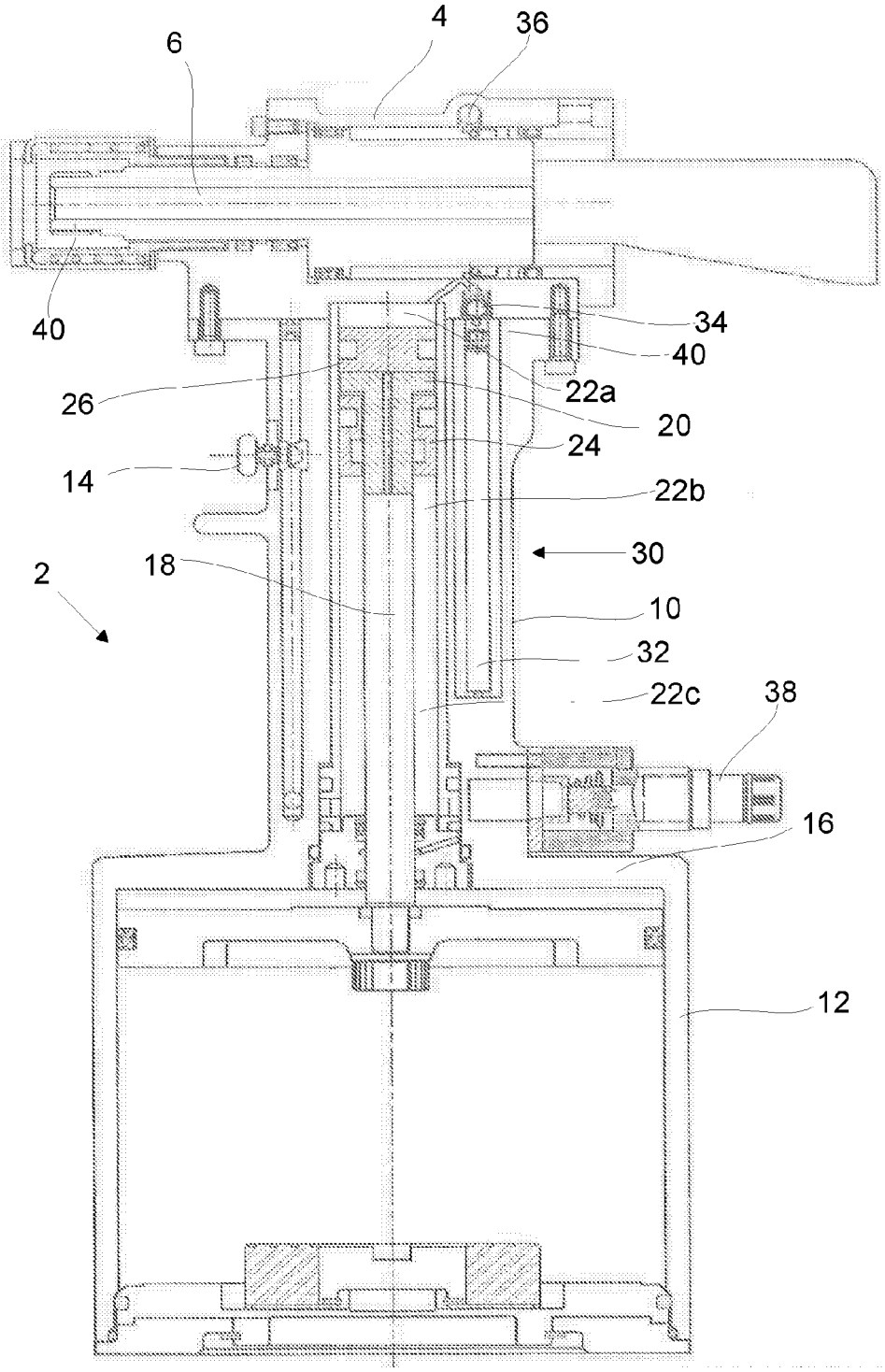
FIG. 4 is a cross-sectional view of the tool of FIG. 1 wherein the tool is at the end of the return/push-off stroke and start of the reservoir exchange.
Figure 6:
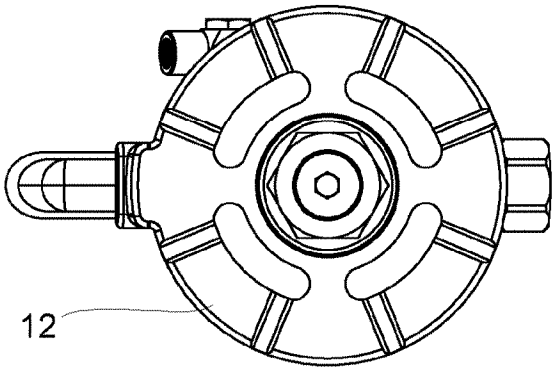
FIG. 6 is an underside view of the tool of FIG. 5.
Figure 5:
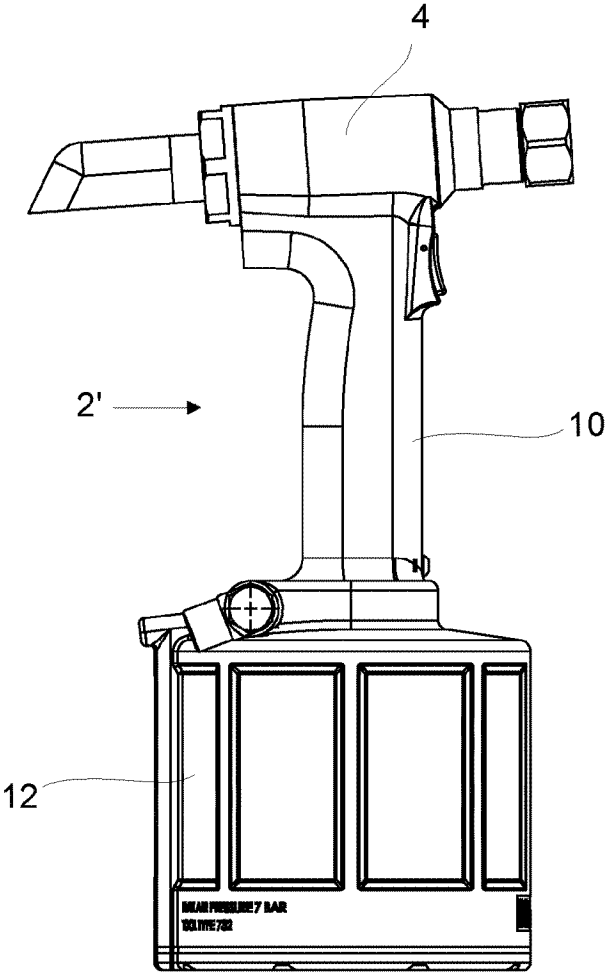
FIG. 5 is a side view of a tool in accordance with a second embodiment the present invention.
Figure 7A:
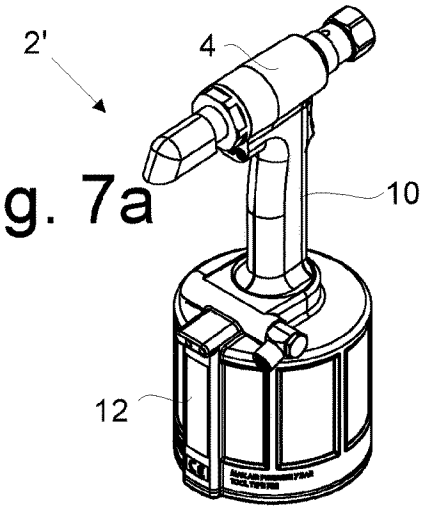
FIGS. 7*a* to 7*d* are isometric views the tool of FIG. 5.
Figure 7B:
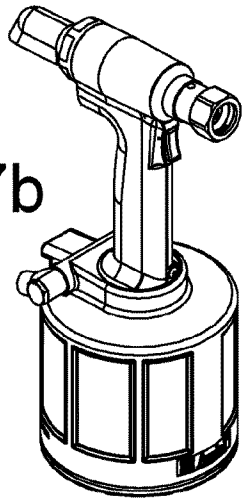
Figure 7C:
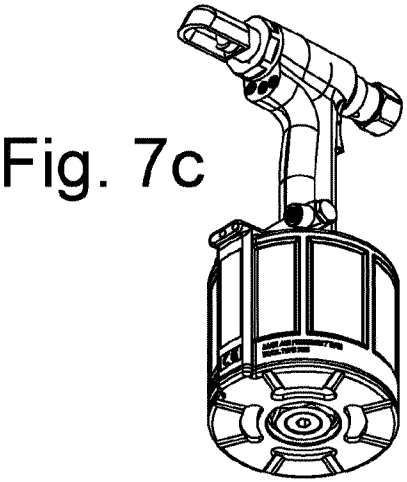
Figure 7D:
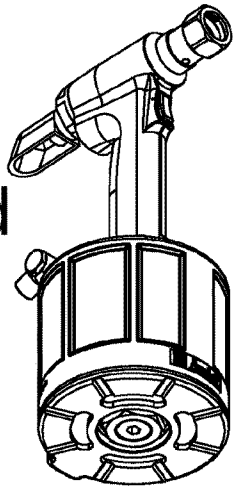
Figure 9:
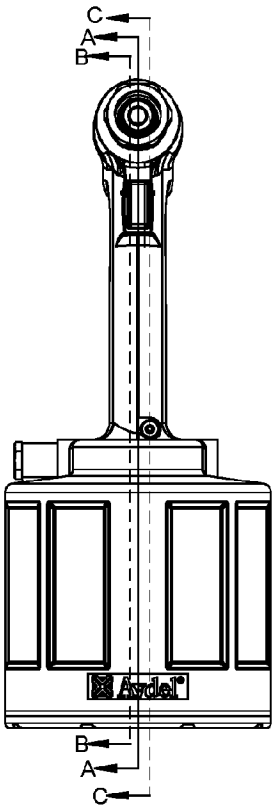
FIG. 9 is a front view of the tool of FIG. 5.
Figure 8:
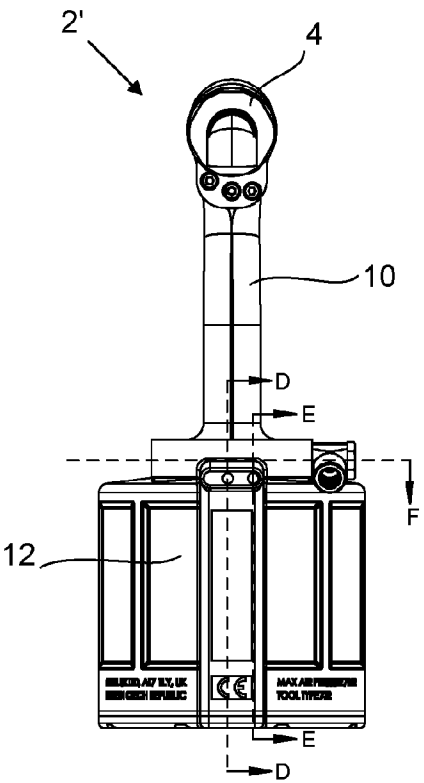
FIG. 8 is a rear view of the tool of FIG. 5.
Figure 12:
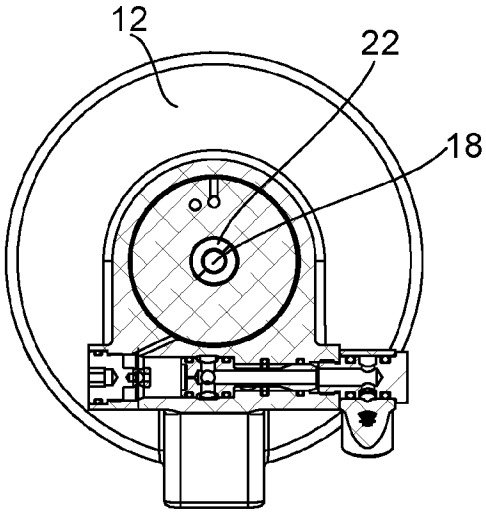
FIG. 12 is a cross-sectional view of the second embodiment of the tool along the lines F-F of FIG. 8 when the tool is in a rest position.
Figure 11:
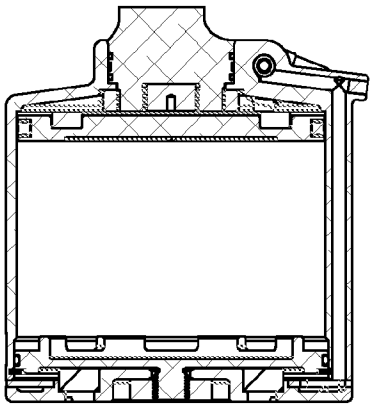
FIG. 11 is a cross-sectional view of the second embodiment of the tool along the lines E-E of FIG. 8 when the tool is in a rest position.
Figure 10:
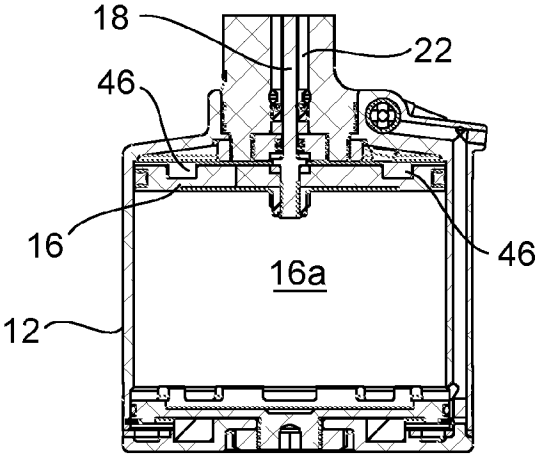
FIG. 10 is a cross-sectional view of the second embodiment of the tool along the lines D-D of FIG. 8 when the tool is in a rest position.
Figure 13:
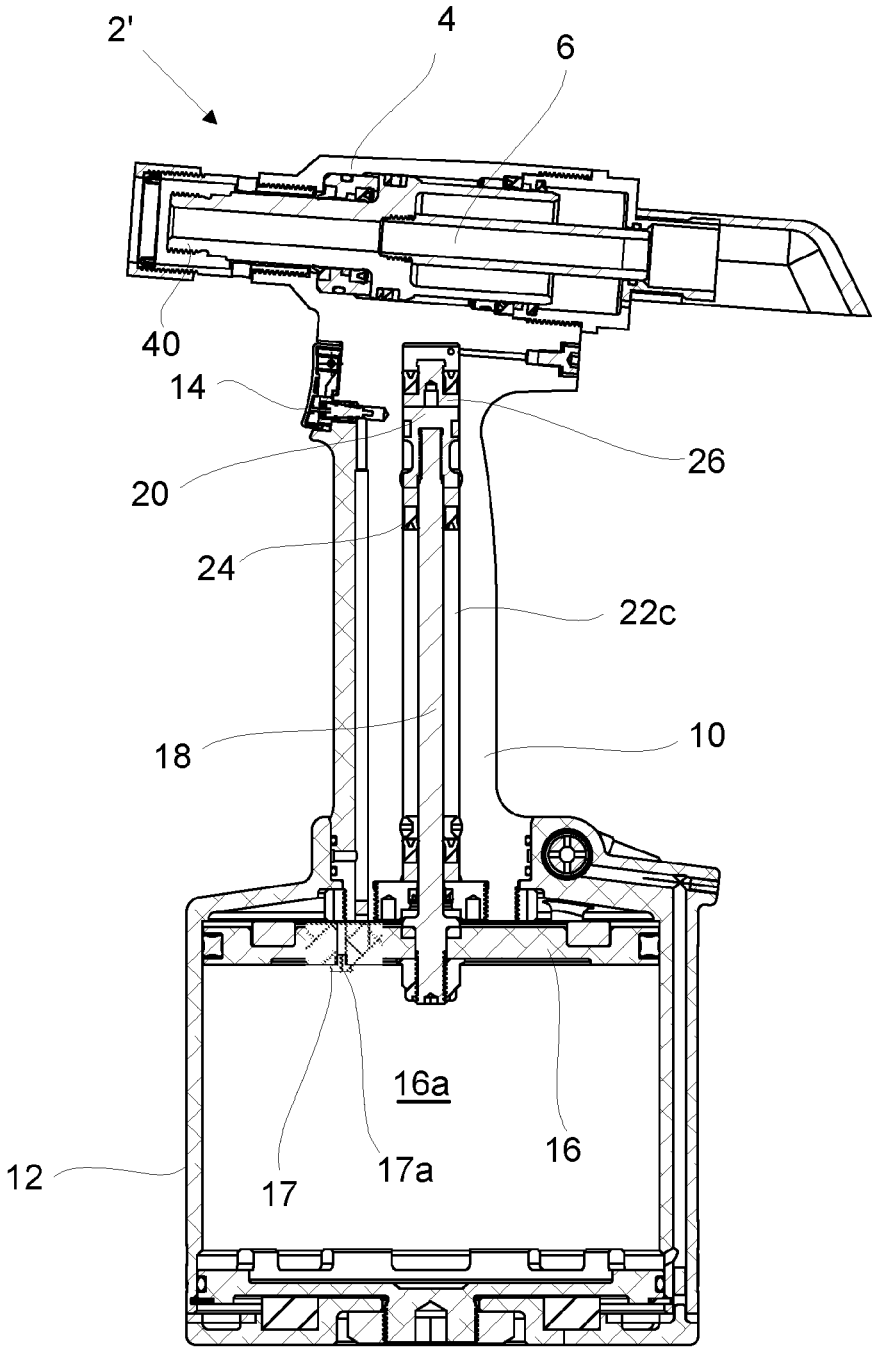
FIG. 13 is a cross-sectional view of the second embodiment of the tool along the lines A-A of FIG. 9 when the tool is in a rest position.

During the return stroke of the tool 2, the check valve 34 prevents oil from being pushed into the reservoir 32 from the return side 22*a* of the main channel 22. When the head piston 6 is at the end stop, as shown in FIG. 4, the pressure relief valve 36 cracks open, thereby allowing excess oil to be pushed back into the reservoir 32. FIG. 1 shows the tool 2 after the exchange of oil into the reservoir 32 has been completed.

In the embodiment shown in FIGS. 1 to 4, the secondary oil circuit 30 is provided within the handle section 10. However, the secondary oil circuit 30 could be located elsewhere on the tool, for example in the head section 4.

A second embodiment of the present invention, as illustrated in FIGS. 5 to 33, differs from the first embodiment in that a secondary oil circuit 30 is not provided. Instead, the tool 2' comprises an integrated oil reservoir, which is provided by an excess volume of oil on the return side 22*a*, i.e. more oil is provided on the return side 22*a* than with the first embodiment. This leads to a loss of pneumatic stroke during a normal cycle of the tool 2'. However, if oil is lost from the return side 22*a* of the main channel 22, extra stroke (shown at 44 on Figures and 14 and 31) of the pneumatic piston 16 is available.

The tool 2' of the second embodiment comprises a seal 46 and a small diameter aperture 17*a* preferably formed in screw 17, both provided on the pneumatic piston 16, which in combination act to reduce the hydraulic pressure which is held on the return side of the head piston 6 during tool inactivity.

Figure 28:
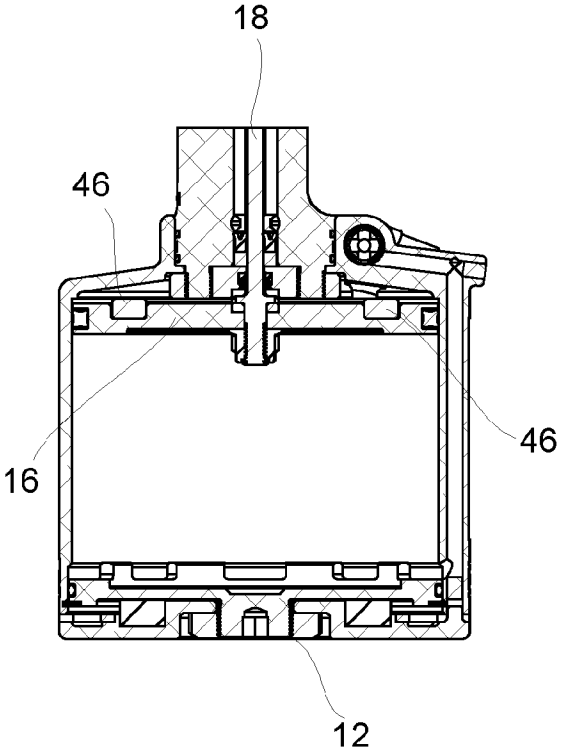
FIG. 28 is a cross-sectional view of the second embodiment of the tool along the lines D-D of FIG. 8 when the tool is at the end of the return/push-off stroke, with a full oil reservoir.
Figure 31:
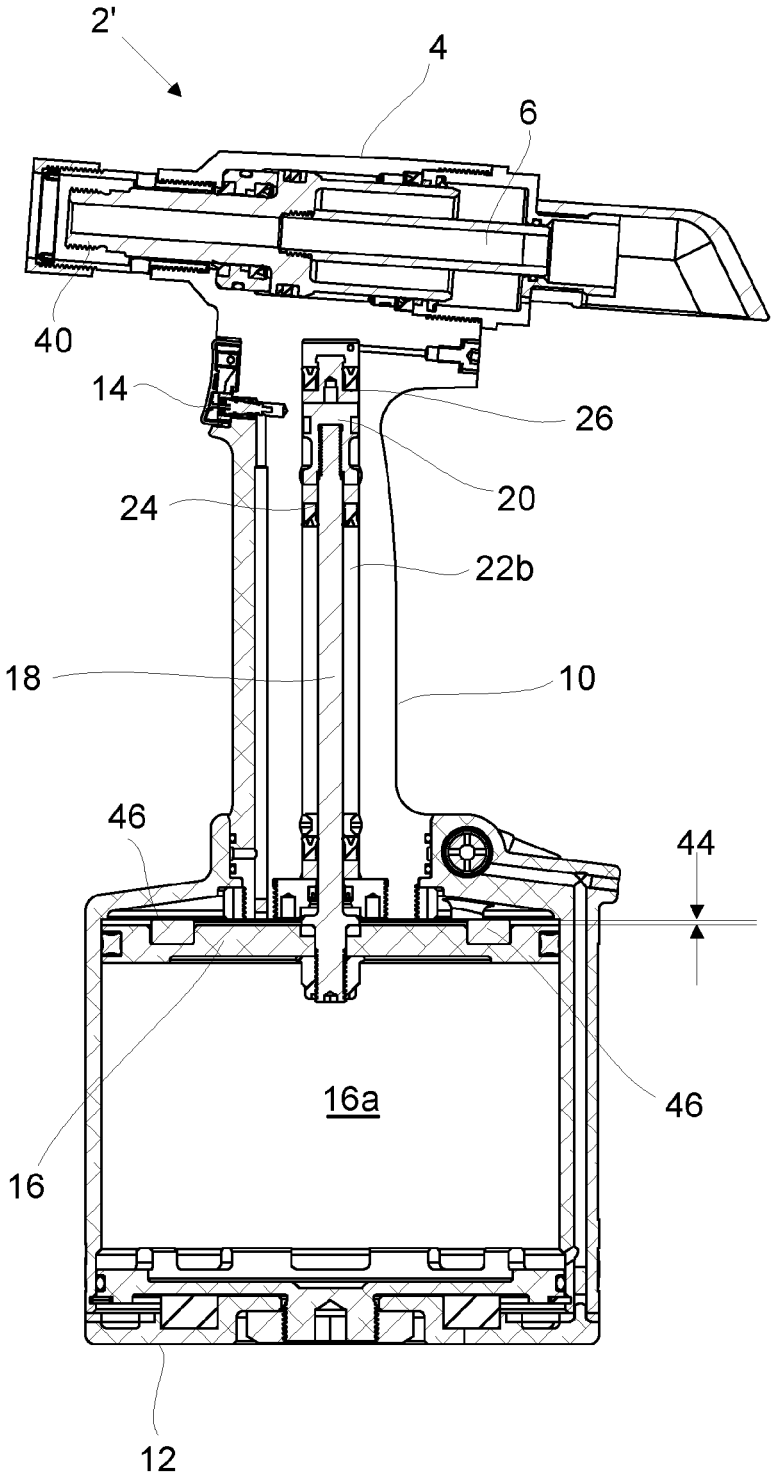
FIG. 31 is a cross-sectional view of the second embodiment of the tool along the lines A-A of FIG. 9 when the tool is at the end of the return/push-off stroke, with a full oil reservoir.
Figure 32:
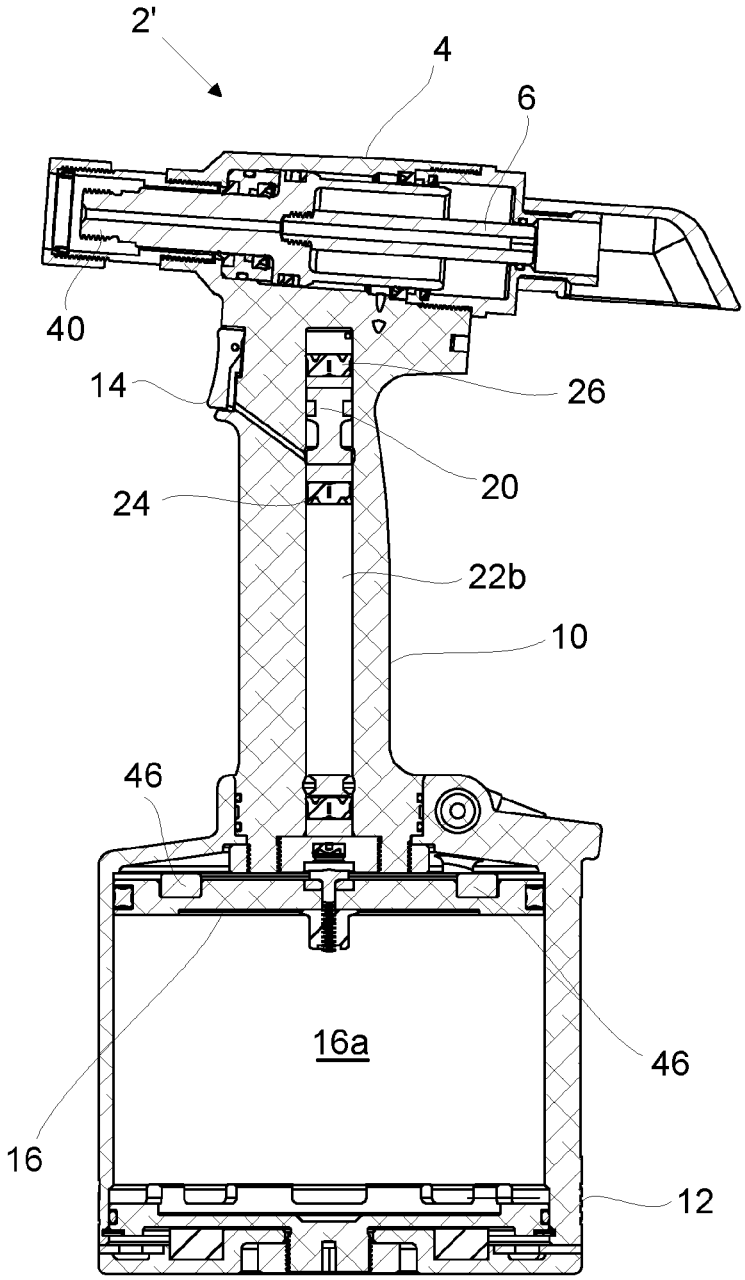
FIG. 32 is a cross-sectional view of the second embodiment of the tool along the lines B-B of FIG. 9 when the tool is at the end of the return/push-off stroke, with a full oil reservoir.
Figure 33:
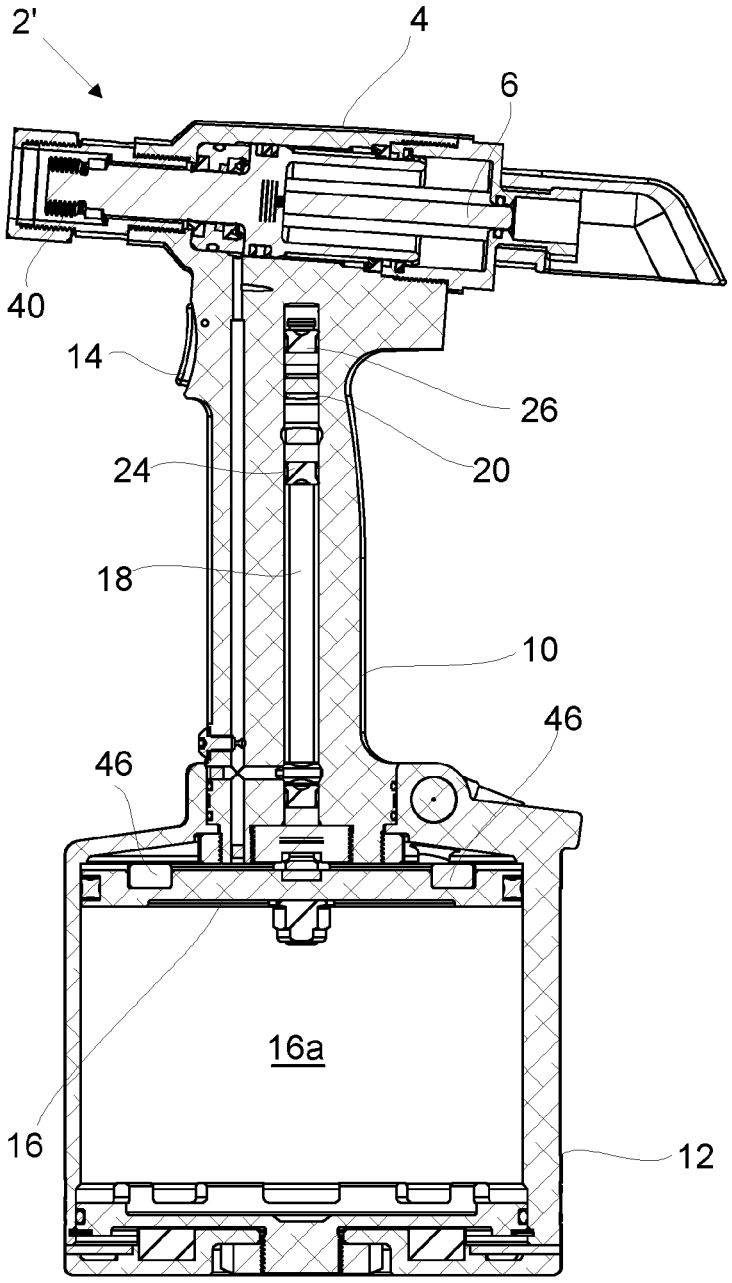
FIG. 33 is a cross-sectional view of the second embodiment of the tool along the lines C-C of FIG. 9 when the tool is at the end of the return/push-off stroke, with a full oil reservoir.
Figure 34:
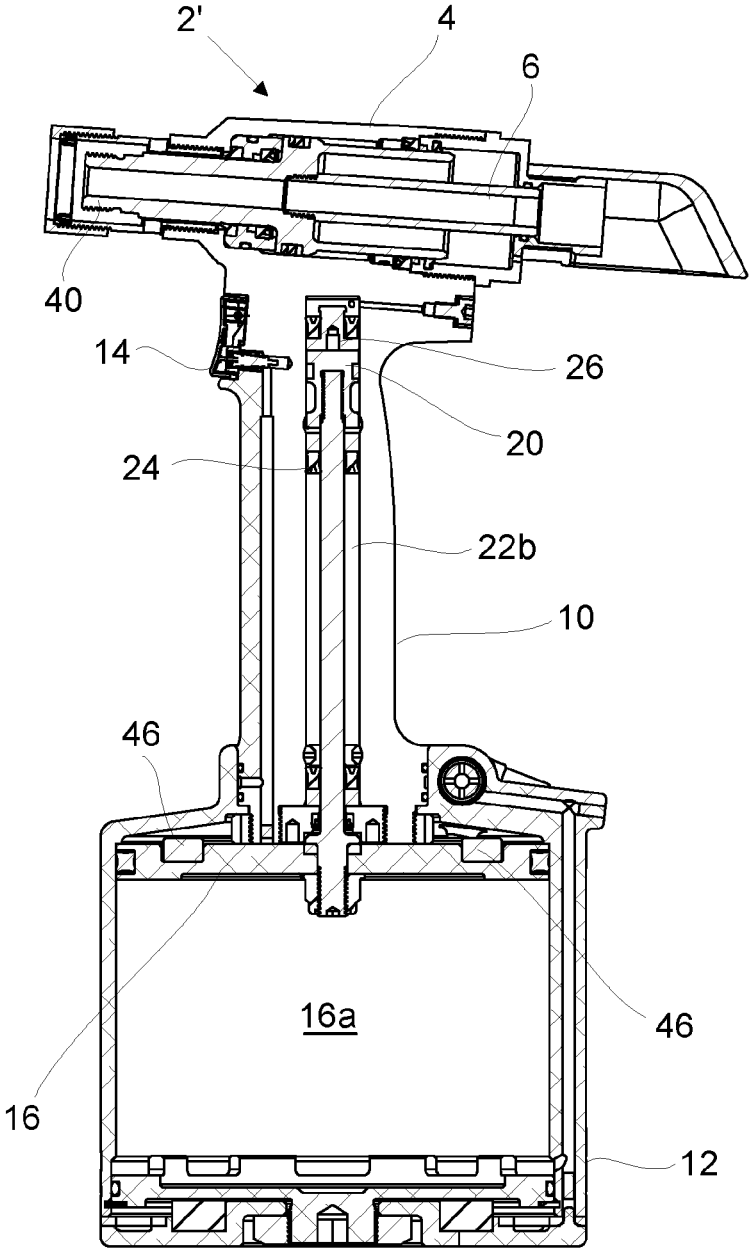
FIG. 34 is a cross-sectional view of the second embodiment of the tool along the lines C-C of FIG. 9 when the tool is at the end of the return/push-off stroke, with an empty oil reservoir.
Figure 35:
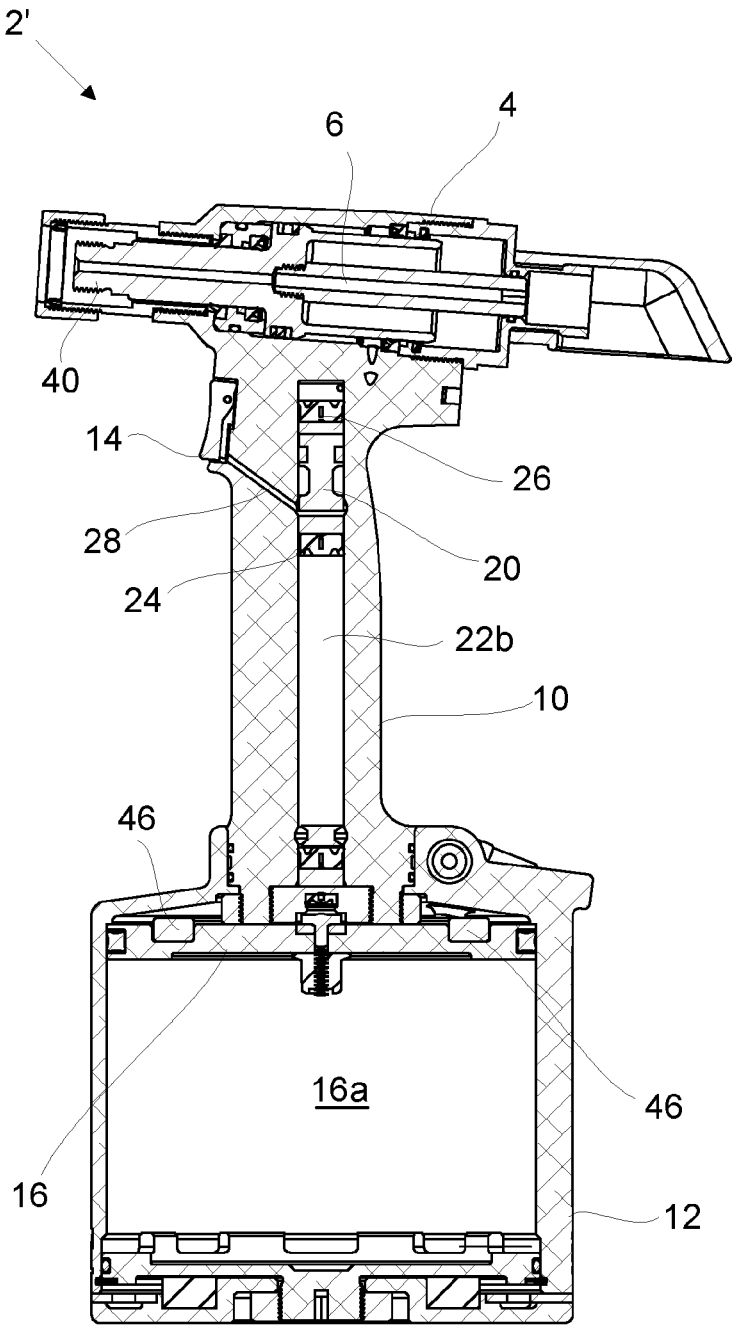
FIG. 35 is a cross-sectional view of the second embodiment of the tool along the lines C-C of FIG. 9 when the tool is at the end of the return/push-off stroke, with an empty oil reservoir.
Figure 36:
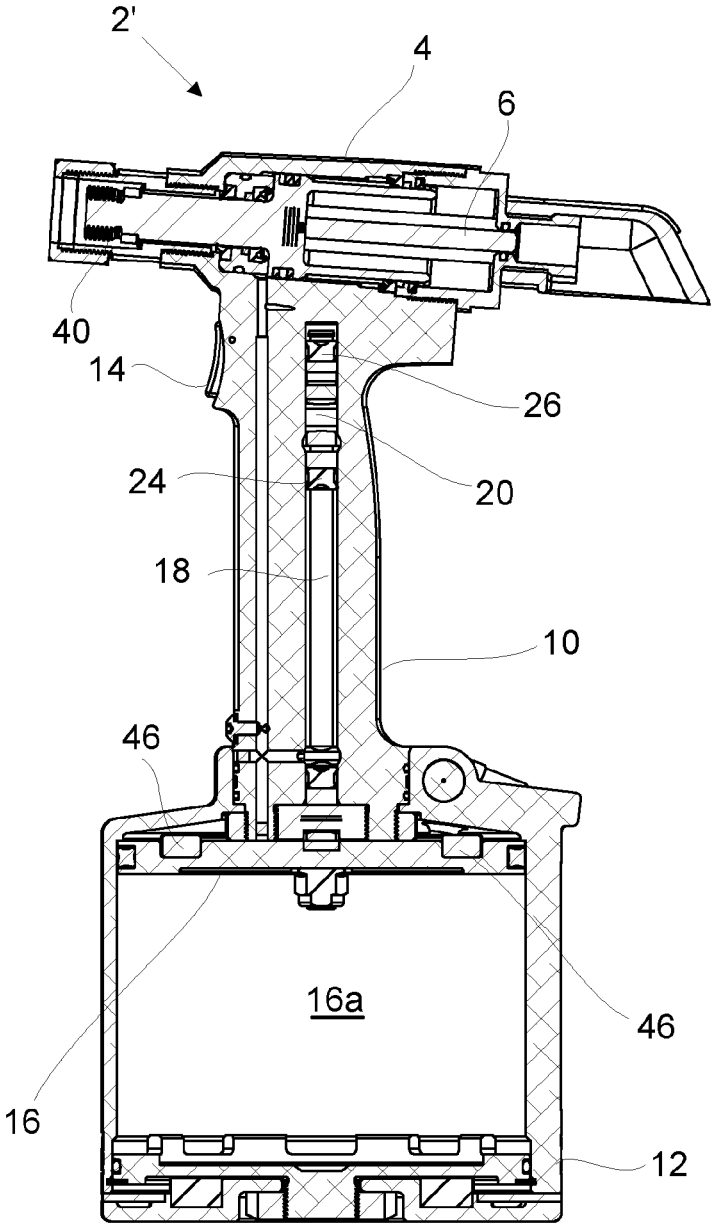
FIG. 36 is a cross-sectional view of the second embodiment of the tool along the lines C-C of FIG. 9 when the tool is at the end of the return/push-off stroke, with an empty oil reservoir.

The seal 46 acts to seat the air inlet/exhaust 47 on the pull side when the pneumatic piston 16 is at the end of the return stroke as shown in FIG. 28.

The small diameter aperture is provided through the pneumatic piston 16, and acts as an air bleed between the pull side 16*a* and return side 16*b* of the pneumatic piston 16, thereby equalising the pressures on either side of the pneumatic piston 16 when the tool 2' is at rest. As there is a larger area on the return side 16*a* of the pneumatic piston 16, pressure is always maintained on the seal 46 to ensure sealing. However, the pressure on the return side of the piston is greatly reduced by the air bleed.

In the second embodiment of the present invention, the lack of secondary oil reservoir reduces tool cost, bulk and complexity.

The invention claimed is:

1. A pneumatically powered fastener installation tool comprising a head section, a handle section, and pneumatic installation means comprising a pneumatic piston coupled to an intensifier rod, wherein the intensifier rod extends into a main channel which has an interior surface forming a single cylinder bore and which is located within the handle section of the tool, and, wherein a pull piston and a return piston are both provided within the cylinder bore, wherein the pull piston and the return piston are free to move within and along substantially the entire length of the cylinder bore in a direction axially with respect to the main channel and with respect to the intensifier rod and wherein in use, the tool conducts a cycle comprising a pull stroke and a return stroke thereby to install a fastener.

2. The tool as claimed in claim 1 further comprising an oil circuit, the oil circuit comprising a positively pressured oil reservoir connected to the main channel via a check valve and a pressure relief valve, and a floating reservoir piston within the oil reservoir.

3. The tool as claimed in claim 2 wherein the oil reservoir is provided in the handle section of the tool.

4. The tool as claimed in claim 1 wherein the tool comprises an integral oil reservoir provided by an excess of oil in a return volume of oil.

5. The tool as claimed in claim 4 further comprising a seal which is fitted to the pneumatic piston, wherein the seal acts to seal an air inlet/exhaust on a pull side when the pneumatic piston is at the end of the return stroke.

6. The tool as claimed in claim 4 further comprising an aperture through the pneumatic piston, wherein the aperture acts as an air bleed across the pneumatic piston.

7. The tool as claimed in claim 5 further comprising an aperture through the pneumatic piston, wherein the aperture acts as an air bleed across the pneumatic piston.

8. The tool as claimed in claim 1, wherein the pull piston and the return piston are both arranged to seal against an inner bore of the main channel.

* * * * *